US005785590A

United States Patent [19]

Tsuchida

[11] Patent Number: 5,785,590

[45] Date of Patent: Jul. 28, 1998

[54] COIN DELIVERING APPARATUS AND HOPPER FOR USE IN SAME

[75] Inventor: Tamotsu Tsuchida, Saitama, Japan

[73] Assignee: Asahi Seiko Kabushiki Kaisha, Tokyo, Japan

[21] Appl. No.: 839,347

[22] Filed: Apr. 18, 1997

Related U.S. Application Data

[63] Continuation of Ser. No. 495,017, Jun. 27, 1995, abandoned.

[30] Foreign Application Priority Data

Jun. 27, 1994 [JP] Japan ..... 6-177378

[51] Int. Cl.[6] ..... G07D 1/00

[52] U.S. Cl. ..... 453/57; 361/221

[58] Field of Search ..... 453/32, 33, 34, 453/35, 49, 57; 361/212, 221

[56] References Cited

U.S. PATENT DOCUMENTS

| | | | |
|---|---|---|---|
| 1,799,784 | 4/1931 | Donnellan | 453/32 |
| 4,352,143 | 9/1982 | Uno | 361/221 |
| 4,753,625 | 6/1988 | Okada | 453/32 |
| 5,122,094 | 6/1992 | Abe | 453/57 |
| 5,377,069 | 12/1994 | Andreasson | 361/221 |
| 5,394,293 | 2/1995 | Graravsky | 361/221 |

*Primary Examiner*—F. J. Bartuska

*Attorney, Agent, or Firm*—Sughrue, Mion, Zinn, Macpeak & Seas, PLLC

[57] ABSTRACT

A coin delivering apparatus includes a hopper for accommodating therein coins at a random, and an agitating unit provided in the hopper for agitating the coins in the hopper. A charge-removing unit is further provided on a surface of or near the hopper. The charge-removing unit supplies, to charges generated on the hopper due to the agitation of the coins executed by the agitating unit, charges having a polarity reverse to that of the generated charges so as to neutralize and remove the generated charges.

30 Claims, 4 Drawing Sheets

COIN DELIVERING APPARATUS AND HOPPER FOR USE IN SAME

This is a continuation of application Ser. No. 08/495,017 filed Jun. 27, 1995 now abandoned.

BACKGROUND OF THE INVENTION

1. Field of the Invention

The present invention relates to a coin delivering apparatus, wherein a large number of disk-shaped objects, such as, coins, medals, tokens or the like (hereinafter generally referred to as "coins") are accommodated in a hopper at random and then delivered outside the hopper. The present invention also relates to a hopper mounted to the foregoing coin delivering apparatus.

2. Description of the Prior Art

Coin delivering apparatuses of this type are known as disclosed in, such as, Japanese First (unexamined) Patent Publication No. 6-150102. In the disclosed apparatus, a coin delivering disk is provided so as to be rotated on an inclined support plate located at one side in a hopper which accommodates therein a large number of coins at random, and the coins in the hopper are transferred outside the hopper while being agitated, due to rotation of the coin delivering disk.

The hopper used in such a coin delivering apparatus is, in general, formed of synthetic resin, such as, ABS resin or polyacetal, and has the property of getting charged in positive or negative when unbalance occurs in quantities of positive and negative charges due to, mainly, friction caused by agitation of the coins. When a charge density on the charged surface of the hopper becomes no less than a certain value, the so-called creeping discharge is generated on the hopper surface for balancing the positive and negative charges.

The electromagnetic wave is generated due to this creeping discharge, which may cause failure in operation of semiconductor devices and other electronic devices.

In order to solve such a problem, experiments were made, wherein the charging prevention method based on earthing and the charging prevention method based on improving conductivity of a material of the hopper were performed. Results are as follows:

First, the charging prevention method based on earthing is effective when the hopper is formed of a material having a high conductivity, such as, metal, while not effective when a material having a low conductivity, such as, the foregoing synthetic resin is used. Accordingly, it can not be an effective solving method.

On the other hand, for improving conductivity of a material of the hopper, a method was performed, as an example, wherein a charging prevention agent (for example, a carbon material) was mixed into the material of the hopper. This method was effective in reducing an amount of charges appearing on the hopper surface.

However, depending on a material of the hopper, there is a case in which mixing of the charging prevention agent is difficult. Further, even when the mixing itself is possible, there is a case in which the mixing was not performed at the time of manufacturing in consideration that the mixing was not necessary. On the other hand, there is also a case in which it is desired to further enhance the charge-removing effect of the hopper already mixed with the charging prevention agent. It is required to deal with all those cases so as to provide charge-removing means effectively.

SUMMARY OF THE INVENTION

Therefore, it is an object of the present invention to provide an improved coin delivering apparatus which is capable of effectively removing charges.

It is another object of the present invention to provide an improved hopper for use in such an improved coin delivering apparatus.

In order to achieve the foregoing objects, according to the present invention, charge-removing means supplies, to positive or negative charges generated on a hopper, charges having a polarity reverse to the generated charges. Specifically, when the hopper is charged in positive, the negative charges are supplied thereto, and when the hopper is charged in negative, the positive charges are supplied thereto, so as to balance the positive and negative charges, thereby neutralizing to remove the generated charges. This removing manner is different from the mere earthing, wherein the generated charges are transferred to be removed.

The reverse-polarity charges can be obtained by using a non-uniform electric field formed between the charged hopper and the charge-removing means. Specifically, when the non-uniform electric field applies electrostatic energy to gaseous molecules near the charge-removing means, the gaseous molecules are ionized, thereby using resultant positive and negative ions.

An expression "neutralize and remove" represents a case in which the charges are eliminated as well as a case in which the charges are reduced.

According to one aspect of the present invention, a coin delivering apparatus includes a hopper for accommodating therein coins at random, and agitating means for agitating the coins accommodated in the hopper. The hopper is, in general, formed of insulating synthetic resin, such as, ABS resin or polyacetal. However, a material of the hopper is not questioned. The hopper may be formed of a conductive material, such as, metal. Further, as described before, the charging prevention agent may be mixed into the synthetic resin. These materials are not against the spirit of the present invention.

On a surface of the hopper, charge-removing means is provided for neutralizing and removing the charges generated upon agitation of the coins. It is preferable that the charge-removing means is in the form of a brush as a later-described embodiment, but is not limited thereto. As long as the charges can be neutralized and removed, a material and a shape thereof are not limited. For example, a metal needle may be mounted as the charge-removing means. Further, the charge-removing means may be provided at any position, even at an end surface, as long as it can be provided. Further, the charge-removing means may be provided near a surface of the hopper and within a distance in which the charge-removing action can be fully applied. Further, although it is sufficient to provide the charge-removing means at least at one location, it may be provided at a plurality of locations.

In general, the agitating means is in the form of an agitating projection provided on a coin delivering disk rotatable in the hopper so as to agitate the coins. However, other agitating means, such as, means for vibrating the hopper itself may be included.

According to another aspect of the present invention, the charge-removing means includes a charge-removing brush formed of conductive fiber. As the charge-removing means, the conductive fiber is used, and further, a form of the brush is used for easy handling of the fiber. In the later-described embodiment, the charge-removing brush has a laterally-elongate shape, but is not limited thereto. For example, it may be arranged to plant the fibers in several layers as a toothbrush. On the other hand, the number of fiber, that is, the brush hair, may be one or more. Further, a length of fiber is not limited as long as the object of the present invention can be achieved. As the conductive fiber, for example, the fiber including carbon fiber or stainless fiber can be preferably used. Further, synthetic resin fiber mixed with metal fiber or a conductive material other than those may also be used. Further, the fibers may be not only mounted in the form of the brush, but also planted at their ends directly onto the hopper body, which is also within the spirit of the present invention.

According to another aspect of the present invention, the charge-removing means and the hopper are arranged to be movable relative to each other. In this case, either of the charge-removing means and the hopper can be arranged to be movable. Specifically, the charge-removing means may be arranged to be movable on the surface of the fixed hopper or near the fixed hopper. To the contrary, the charge-removing means may be fixed on the surface of or near the hopper, and the hopper may be moved. As appreciated, both the charge-removing means and the hopper may also be arranged to move in mutually different directions so as to change a relative confronting position therebetween.

According to another aspect of the present invention, one end of the charge-removing means may be grounded. By this arrangement, among ions generated near the charge-removing means, those unnecessary ions which do not contribute to the removal of charges, can be removed. As a result, it is possible that a charged voltage of the charged object, that is, the hopper, can be further lowered as compared with a case where the charge-removing means is not grounded, although it also depends on a material and a charged voltage of the charged object, and further depends on the ambient conditions of the charged object.

According to another aspect of the present invention, the foregoing hopper may be used as a substitution for the known hopper which, for example, has no charge-removing means. Accordingly, for example, the hopper with the charge-removing means can be used in the conventional coin delivering apparatus in place of the hopper with no charge-removing means. Thus, in the coin delivering apparatus which has been used, the problem of the charging of the hopper can be dealt with afterwards when it becomes necessary.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, a preferred embodiment of the present invention will be described hereinbelow with reference to the accompanying drawings.

Figure 1:
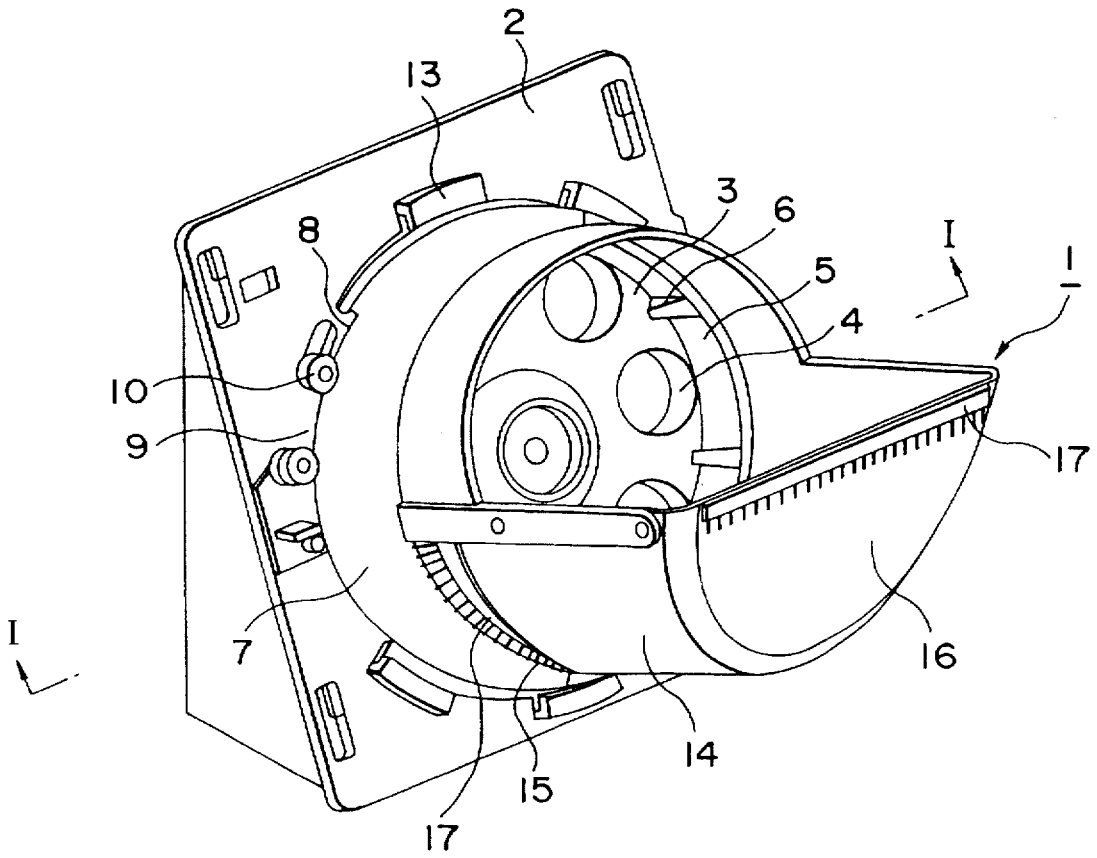
FIG. 1 is a schematic perspective view showing a coin delivering apparatus according to a preferred embodiment of the present invention.
Figure 2:
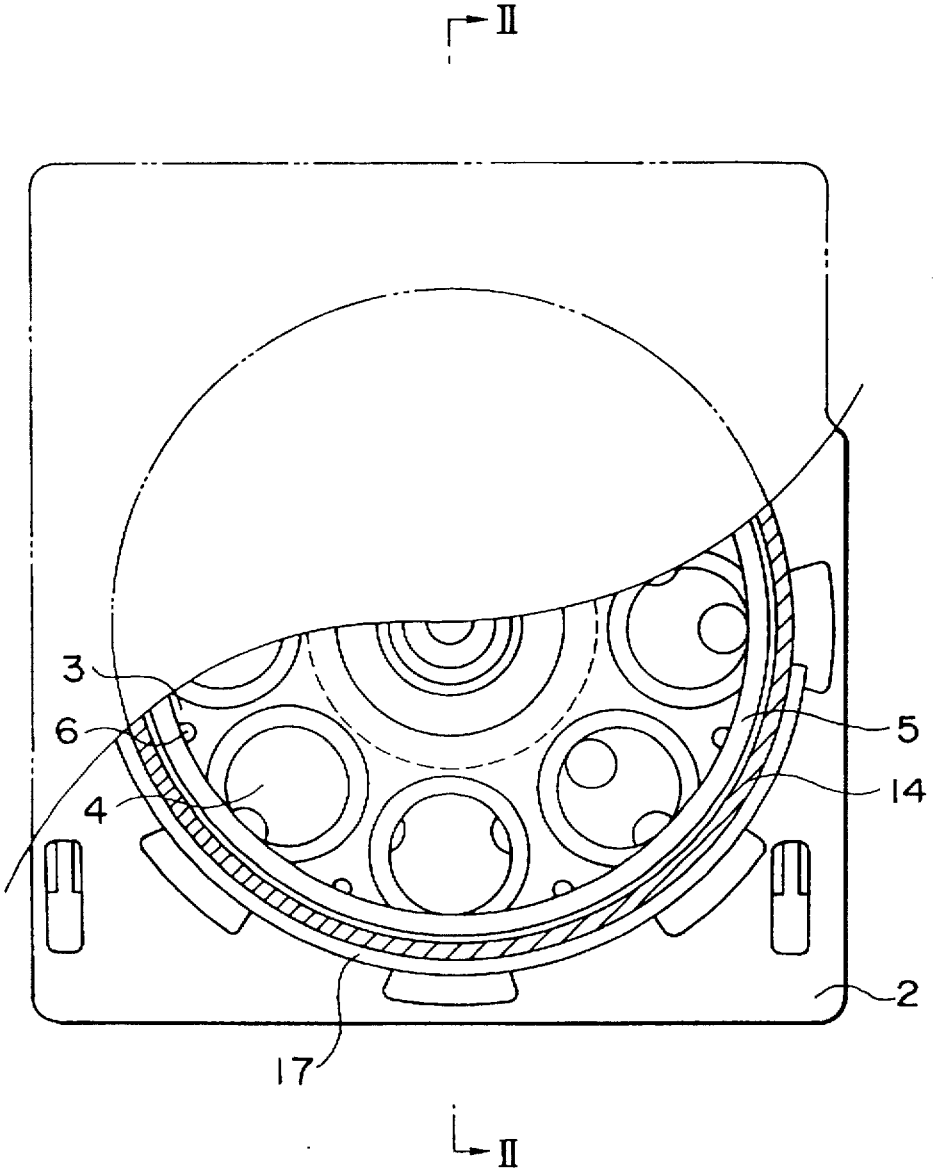
FIG. 2 is a schematic diagram showing a partly-broken section taken alone line I—I in FIG. 1.

FIG. 1 shows a coin delivering apparatus according to the preferred embodiment of the present invention.

In FIG. 1, the coin delivering apparatus includes a hopper 1 for accommodating coins at random and a coin delivering disk 3 which is rotated on an inclined support plate 2 in the hopper 1. The hopper 1 includes a hopper cylindrical portion 7 and an arc-shaped bottom portion 14 which are coupled to each other via a step 15 interposed therebetween. Further, the hopper 1 includes a front plate 16 which is continuous with the arc-shaped bottom portion 14. The cylindrical portion 7 of the hopper 1 is detachably mounted onto the inclined support plate 2 via a fitting joint 13. The fitting joint 13 surrounds the cylindrical portion 7 so as to allow the disk 3 to rotate within the cylindrical portion 7. A cut-out 8 is formed at an end surface of the cylindrical portion 7 to provide a coin outlet hole 9 between the cut-out 8 and a surface of the inclined support plate 2. Further, a count roller 10 is provided on the inclined support plate 2 adjacent to the coin outlet hole 9 for counting the coins delivered out of the coin outlet hole 9.

The hopper 1 is formed of synthetic resin, such as, ABS resin or polyacetal, and thus in general lacks conductivity. A charging prevention agent, such as, a carbon material, may be mixed to improve conductivity.

Figure 3:
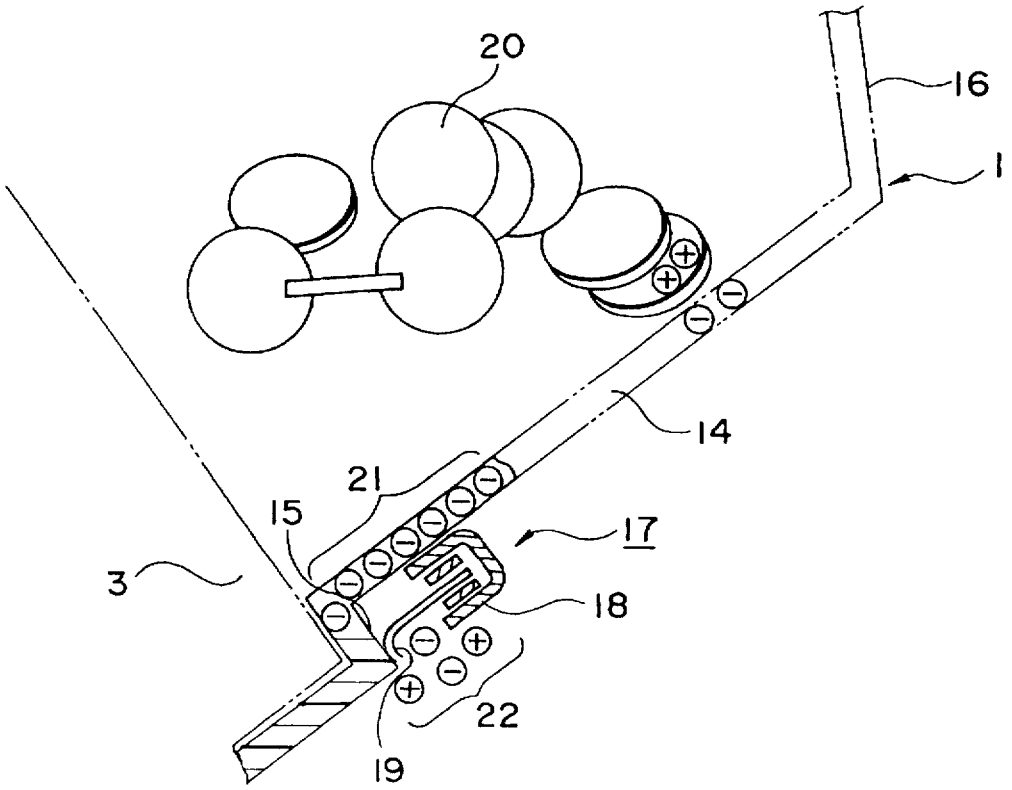
FIG. 3 is a schematic diagram showing a partly-broken section taken alone line II—II in FIG. 2.
Figure 4:
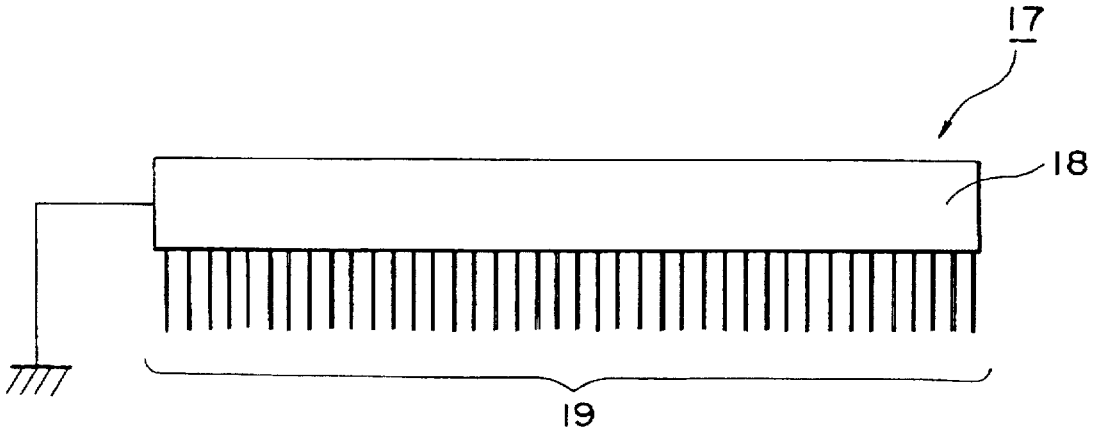
FIG. 4 is an enlarged front view of a charge-removing brush shown in FIGS. 1 to 3.

Referring to FIG. 3, a charge-removing brush 17, as charge-removing means, is mounted onto an external surface of the arc-shaped bottom portion 14 of the hopper 1. The charge-removing brush 17 is located close to the step 15 and extends over substantially the full width of the arc-shaped bottom portion 14. As shown in FIG. 4, the charge-removing brush 17 includes an elongate brush stem 18 and a brush hair 19 made of stainless fiber, and has a shape of an elongate flat brush as a whole.

The charge-removing brush 17 is mounted onto the arc-shaped bottom portion 14 by proper mounting means, such as, a pressure sensitive adhesive double coated tape. The charge-removing brush 17 is arranged at a position such that the tip of the brush hair 19 slightly abuts the step 15. As shown in FIG. 4, it is also effective to ground the other end, that is, the root portion, of the brush hair 19 for removing charges. When the brush stem 18 is formed of a conductive material, it is effective to ground the brush stem 18. A mounting position of the charge-removing brush 17 is not limited to the external surface of the arc-shaped bottom portion 14 as shown in FIG. 3. For example, it can be mounted onto an external surface of the cylindrical portion 7 or onto an external surface of the front plate 16 as shown in FIG. 1. It can also be mounted onto an inner surface within the hopper i. Further, it is possible to provide the charge-removing brushes at a plurality of positions, for example, at the cylindrical portion 7, the arc-shaped bottom portion 14 and other portions, or it is also possible to mount small pieces of the charge-removing brush at one position in a scattered manner.

Referring to FIG. 1, the coin delivering disk 3 will be described. The disk 3 is driven in a counter-clockwise direction within the cylindrical portion 7 of the hopper 1 by a motor (not shown) provided at the back of the inclined support plate 2. The disk 3 is provided with coin receiving holes 4 at radially-outward portions, spacing from each other in a circumferential direction. Each of the coin receiving holes 4 is formed through the disk 3 and has a size large enough to receive therein the coin. The coin received in the coin receiving hole 4 is transferred upward in the hopper 1 due to rotation of the disk 3, and thereafter, delivered out of the coin outlet hole 9 pushing away the count roller 10. On the other hand, the disk 3 is provided with a disk circumferential wall 5 extending from the circumference thereof toward the hopper 1. The disk circumferential wall 5 is provided with a plurality of agitating projections 6, as agitating means, on an inner surface thereof. The agitating projections 6 are provided for agitating, due to rotation of the disk 3, the coins accommodated in the hopper 1 at random. The agitation of the coins is performed mainly by the agitating projections 6. On the other hand, for example, the coin receiving holes 4 or the like also work as agitating means.

FIG. 3 schematically shows the state of charging of the hopper 1 and the state of ionization of gaseous molecules around the charge-removing brush 17. As described above, due to rotation of the disk 3, the agitated coins 20 repeat abutting the inner surface of the hopper 1 one after another so that the hopper 1 is charged in positive or negative. Therefore, to the positive or negative charges appearing on the hopper, charges having a reverse polarity are supplied using the foregoing charge-removing means for balancing the positive and negative charges, thereby neutralizing to remove the generated charges.

In FIG. 3, numeral 21 denotes charges appearing on the hopper 1, and numeral 22 denotes reverse-polarity charges generated by the action of the charge-removing brush 17, i.e. the charge-removing means.

In a laboratory, about 1,000 brass medals (diameter: 25 mm; thickness: 1.6 mm) were accommodated in the hopper formed of polyacetal. Stainless fibers each having a diameter of 12 μm were bound into bundles each formed of 100 fibers. The bundles were mounted onto the external surface of the arc-shaped bottom portion 14 over the full width thereof at intervals of 2 mm. The agitation was performed in this state, and a charged voltage was about 9 kv. On the other hand, when the charge-removing means was grounded, it was confirmed that a charged voltage was reduced to about 3 kv.

Figure 5:
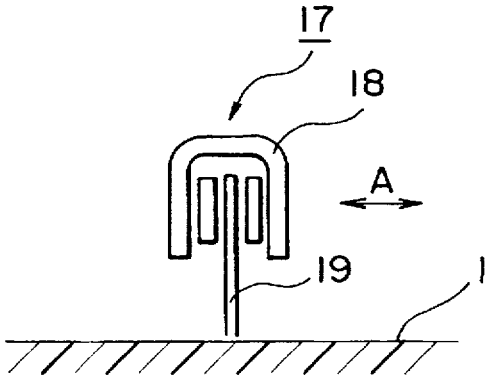
FIG. 5 is a schematic diagram showing a relative position between a charge-removing brush and a hopper.
Figure 6:
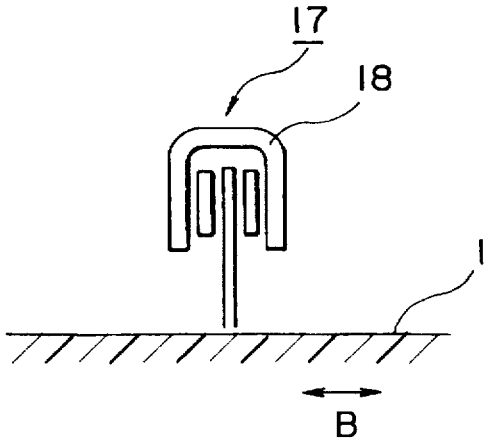
FIG. 6 is a schematic diagram showing a relative position between a charge-removing brush and a hopper.
Figure 7:
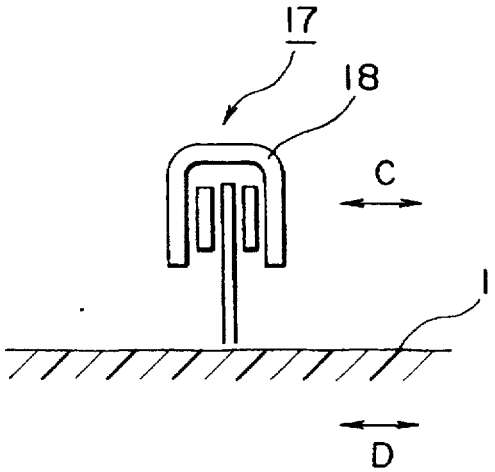
FIG. 7 is a schematic diagram showing a relative position between a charge-removing brush and a hopper.

The charge-removing means and the hopper may be arranged to be movable relative to each other. In this case, either of the charge-removing means and the hopper may be arranged to be movable. Specifically, as shown in FIG. 5, the charge-removing means 17 may be arranged to be movable (arrow A) on or near the surface of the fixed hopper 1. To the contrary, as shown in FIG. 6, the charge-removing means 17 may be fixed on or near the surface of the hopper 1, and the hopper 1 may be arranged to be movable (arrow B). As appreciated, as shown in FIG. 7, both the charge-removing means 17 and the hopper 1 may also be arranged to move in mutually different directions (arrow C and arrow D) so as to change a relative confronting position therebetween.

As appreciated, the hopper in the foregoing preferred embodiment and modifications may be used as a substitution for the known hopper having no charge-removing means. Accordingly, for example, the hopper with the charge-removing means can be used in the conventional coin delivering apparatus in place of the hopper with no charge-removing means. Thus, in the coin delivering apparatus which has been used, the charging of the hopper can be dealt with afterwards when it becomes necessary.

As appreciated, in the foregoing preferred embodiment and modifications, the charges on the surface of the charged hopper can be effectively removed irrespective of a material of the hopper. Accordingly, a charge density on the surface of the charged hopper can be suppressed to a smaller value. Therefore, the so-called creeping discharge is prevented from being generated on the hopper surface. Thus, generation of the electromagnetic wave due to the creeping discharge and thus failure in operation of semiconductor devices and other electronic devices incorporated in the coin delivering apparatus can be effectively prevented.

It is to be understood that this invention is not to be limited to the preferred embodiments and modifications described above, and that various changes and modifications may be made without departing from the spirit and scope of the invention as defined in the appended claims.

What is claimed is:

1. A coin delivering apparatus comprising:

a stationary hopper for accommodating therein coins at random;

agitating means provided in the hopper for agitating the coins in said hopper; and a passive charge-removing means provided on a surface of or near said hopper for supplying, to charges generated on the hopper due to the agitation of the coins caused by said agitating means, charges having a polarity reverse to that of the generated charges so as to neutralize and remove the generated charges.

2. The coin delivering apparatus according to claim 1, wherein said charge-removing means includes a charge-removing brush formed of a plurality of conductive fibers.

3. The coin delivering apparatus as set forth in claim 1, wherein said charge-removing means includes carbon fiber and/or stainless fiber.

4. The coin delivering apparatus according to claim 1, wherein said charge-removing means and said hopper are movable relative to each other.

5. The coin delivering apparatus according to claim 1, wherein one end of said charge-removing means is grounded.

6. The coin delivering apparatus according to claim 1, wherein said hopper comprises a synthetic resin.

7. The coin delivering apparatus according to claim 1, wherein said charge-removing means are disposed at a plurality of locations on a surface of or near said hopper.

8. The coin delivering apparatus according to claim 2, wherein said conductive fibers are not connected to each other and are independently separated, and at least one of said conductive fibers barely touches said hopper while remainder of said conductive fibers do not touch said hopper.

9. A coin delivering apparatus comprising:

a stationary hopper for accommodating therein coins at random;

agitating means provided in the hopper for agitating the coins in said hopper; and a passive charge-removing brush provided on a surface of or near said hopper for supplying, to charges generated on the hopper due to the agitation of the coins caused by said agitating means, charges having a polarity reverse to that of the generated charges so as to neutralize and remove the generated charges, said charge-removing brush formed of a plurality of conductive fibers.

10. The coin delivering apparatus according to claim 9, wherein said charge-removing brush includes carbon fiber and/or stainless fiber.

11. The coin delivering apparatus according to claim 9, wherein said charge-removing brush and said hopper are movable relative to each other.

12. The coin delivering apparatus according to claim 9, wherein one end of said charge-removing brush is grounded.

13. A coin delivering apparatus comprising:

a stationary hopper for accommodating therein coins at random;

agitating means provided in the hopper for agitating the coins in said hopper; and a passive charge-removing brush provided on a surface of or near said hopper for supplying, to charges generated on the hopper due to the agitation of the coins caused by said agitating means, charges having a polarity reverse to that of the generated charges so as to neutralize and remove the generated charges, said charge-removing brush formed of carbon fibers or stainless fibers.

14. The coin delivering apparatus according to claim 13, wherein said charge-removing brush and said hopper are movable relative to each other.

15. The coin delivering apparatus according to claim 13, wherein one end of said charge-removing brush is grounded.

16. A stationary hopper mounted to a coin delivering apparatus having agitating means for agitating coins at random, said hopper accommodating therein said agitating means and said coins, said hopper comprising a passive charge-removing means provided on a surface of or near said hopper for supplying, to charges generated on the hopper due to the agitation of the coins caused by said agitating means, charges having a polarity reverse to that of the generated charges so as to neutralize and remove the generated charges.

17. The hopper according to claim 16, wherein said charge-removing means includes a charge-removing brush formed of a plurality of conductive fibers.

18. The hopper according to claim 16, wherein said charge-removing means includes carbon fiber and/or stainless fiber.

19. The hopper according to claim 16, wherein said charge-removing means and said hopper are movable relative to each other.

20. The hopper according to claim 16, wherein one end of said charge-removing means is grounded.

21. A stationary hopper mounted to a coin delivering apparatus having agitating means for agitating coins at random, said hopper accommodating therein said agitating means and said coins, said hopper comprising a passive charge-removing brush provided on a surface of or near said hopper for supplying, to charges generated on the hopper due to the agitation of the coins caused by said agitating means, charges having a polarity reverse to that of the generated charges so as to neutralize and remove the generated charges, said charge-removing brush formed of a plurality of conductive fibers.

22. The hopper according to claim 21, wherein said charge-removing brush includes carbon fiber and/or stainless fiber.

23. The hopper according to claim 21, wherein said charge-removing brush and said hopper are movable relative to each other.

24. The hopper according to claim 21, wherein one end of said charge-removing brush is grounded.

25. A stationary hopper mounted to a coin delivering apparatus having agitating means for agitating coins at random, said hopper accommodating therein said agitating means and said coins, said hopper comprising a passive charge-removing brush provided on a surface of or near said hopper for supplying, to charges generated on the hopper due to the agitation of the coins caused by said agitating means, charges having a polarity reverse to that of the generated charges so as to neutralize and remove the generated charges, said charge-removing brush formed of carbon fibers or stainless fibers.

26. The hopper according to claim 25, wherein said charge-removing brush and said hopper are movable relative to each other.

27. The hopper according to claim 25, wherein one end of said charge-removing brush is grounded.

28. A coin delivering apparatus, comprising:

a hopper for accommodating coins therein at random;

agitating means for agitating coins in said hopper; and a brush having a plurality of conductive fiber bristles, said conductive fiber bristles being grouped into a plurality of fiber bundles such that each of said plurality of fiber bundles is physically separated from other fiber bundles, and said brush is mounted on said hopper such that said fiber bundles can remove electrical charges generated from said agitating coins by forming a non-uniform electric field between said hopper and said brush which discharges said electrical charges by ionizing ambient gas molecules near said plurality of fiber bundles.

29. The coin delivering apparatus of claim 28 wherein said brush is grounded.

30. The coin delivering apparatus of claim 28 wherein said brush is not grounded and said plurality of fiber bundles are not electrically connected with other fiber bundles.

* * * * *